US005988129A

United States Patent [19]

Prior et al.

[11] Patent Number: 5,988,129

[45] Date of Patent: Nov. 23, 1999

[54] ENGINE LUBRICATION SYSTEM

[75] Inventors: Gregory Paul Prior, Birmingham; Frank R. Zsirai, Beverly Hills; Ambyr D. Peterson, Pinckney, all of Mich.

[73] Assignee: General Motors Corporation, Detroit, Mich.

[21] Appl. No.: 09/157,873

[22] Filed: Sep. 21, 1998

[51] Int. Cl.[6] ..... F01M 9/10

[52] U.S. Cl. ..... 123/90.34; 123/90.33; 123/196 M; 184/6.5; 184/11.1

[58] Field of Search ..... 123/90.31, 90.33, 123/90.34, 90.38, 196 R, 196 M; 184/6.5, 6.9, 11.1, 11.5, 13.1

[56] References Cited

U.S. PATENT DOCUMENTS

| | | | |
|---|---|---|---|
| 4,343,270 | 8/1982 | Kawabe | 123/196 V |
| 4,881,497 | 11/1989 | Matayoshi et al. | 123/90.34 |
| 4,944,264 | 7/1990 | Murasaki et al. | 123/195 C |
| 4,987,974 | 1/1991 | Crouch | 184/6.12 |
| 5,033,989 | 7/1991 | Shimaguchi | 474/8 |
| 5,447,127 | 9/1995 | Luck et al. | 123/90.31 |

*Primary Examiner*—Weilun Lo
*Attorney, Agent, or Firm*—Laura C. Wideman; Karl F. Barr, Jr.

[57] ABSTRACT

An overhead cam engine with an engine lubrication system comprises a valve train assembly which includes a camshaft rotatably supported by a cylinder head. An oil lubricated camshaft drive chain engages the camshaft to rotate it. A valve train lubricating assembly is disposed above the cylinder head and includes a baffle, radially positioned from the drive chain, to capture oil spray departing from the drive chain and a trough positioned above the valve train assembly. The trough is configured as an upward facing U-shaped channel, including an end wall to close the trough, defining a reservoir to collect oil from the baffle. Side outlets allow oil to overflow from the trough where outward protruding dimples act as precipitation points to target lubrication onto the valve train assembly.

5 Claims, 2 Drawing Sheets

ENGINE LUBRICATION SYSTEM

TECHNICAL FIELD

The invention relates to an engine lubrication system for overhead cam (OHC) engines.

BACKGROUND OF THE INVENTION

Engine lubrication systems provide many functions such as wear protection, corrosion protection, and engine cooling. One drawback is that engine power is diverted to operating a high pressure oil pump to distribute oil through passages in the engine, which weighs against engine efficiency. Overhead cam (OHC) engines present a challenge to adequately and reliably lubricate the valve train without creating an undue demand on the engine lubrication system.

In an internal chain-driven camshaft OHC engine, as the chain is driven around the cam sprocket, the centrifugal force creates a steady spray of oil from the chain and cam sprocket onto the cam cover. The oil drains into the engine oil reservoir without providing lubrication to valve train components. This source of unpressurized oil presents an opportunity for providing lubrication to valve train components.

SUMMARY OF THE INVENTION

The invention is an engine lubrication system including a valve train lubricating assembly for an overhead cam engine. During operation, a baffle captures unpressurized oil spray from a cam sprocket and drive chain before it returns to the engine oil reservoir. A reservoir trough transports and distributes the captured oil above a camshaft. Strategically placed outlets of the trough direct oil overflow to selectively target and lubricate valve train components below. The valve train lubricating assembly collects, transports, and selectively directs lubrication without imposing additional demands on the oil pump or reducing system oil pressure.

DESCRIPTION OF THE PREFERRED EMBODIMENT

Figure 1:
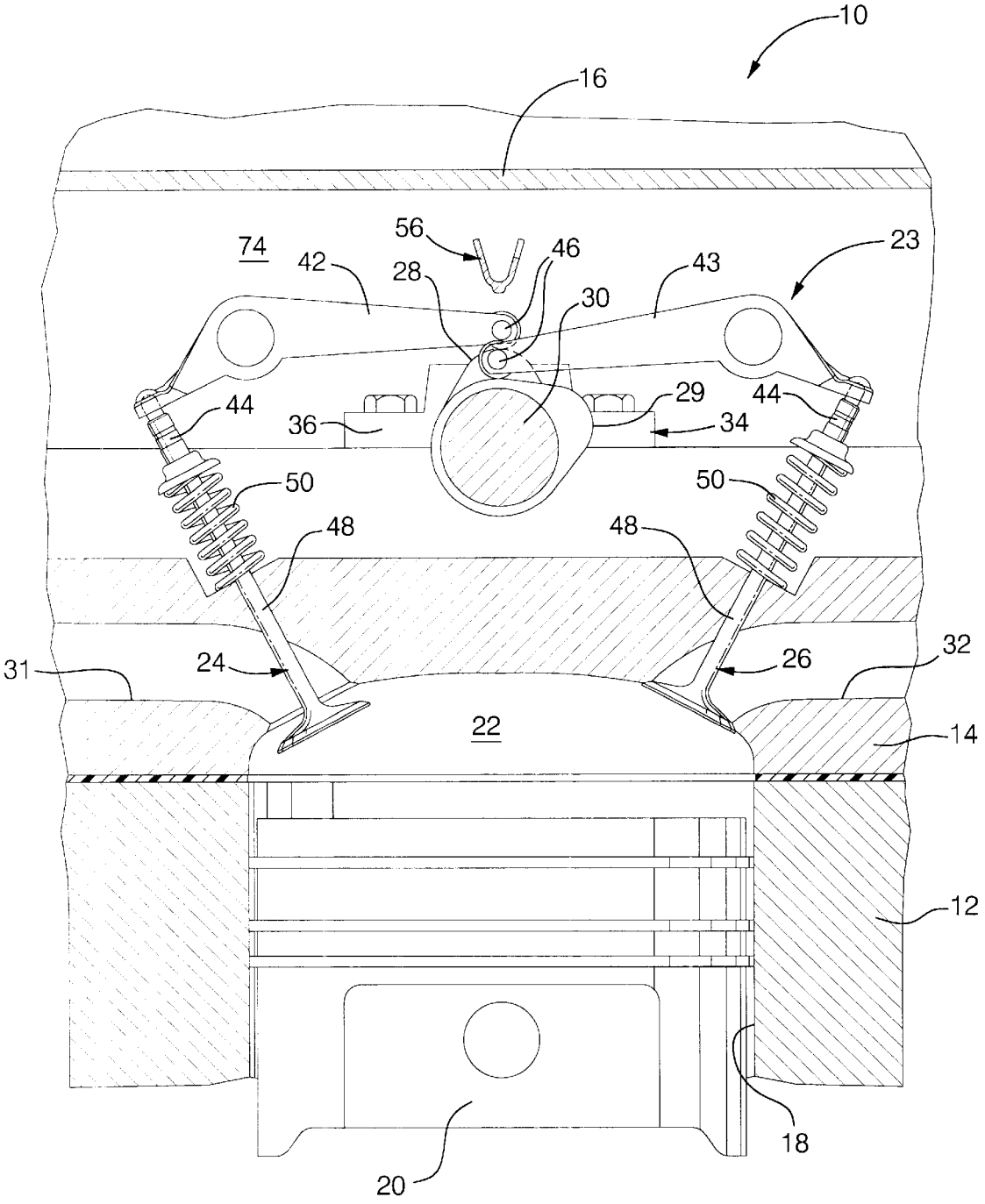
FIG. 1 is a schematic front view, in section, of a portion of an OHC engine embodying the present invention.

In FIG. 1, there is illustrated a single OHC engine, generally referred to as 10, including an engine cylinder block 12, an engine cylinder head 14, and a cam cover 16. The cylinder head 14 is mounted on the cylinder block 12 and the cam cover 16 covers the head. The cylinder block 12 has a plurality of engine cylinders 18. An engine piston 20 is disposed within each cylinder 18 for reciprocal movement. The cylinders 18 are covered by a cylinder head 14. The piston 20 and the cylinder head 14 cooperate to define a combustion chamber 22 therebetween.

A valve train assembly 23 includes intake and exhaust valves 24 and 26 driven by intake and exhaust cams 28 and 29 disposed on a rotatable camshaft 30. Each cylinder 18 has an intake valve 24 to supply air, and fuel in some applications, to the combustion chamber 22 from an intake passage 31, and an exhaust valve 26 to exhaust combustion gases through an exhaust passage 32.

The cylinder head 14 rotatably supports the longitudinal camshaft 30 in transverse camshaft journal bearing assemblies 34. Camshaft bearing caps 36 are bolted to the head 14 to secure the camshaft 30 to the head. An engine lubrication system delivers oil to the camshaft journal bearing assemblies 34 through pressurized oil orifices, not shown, in the head 14. Intake and exhaust cams 28,29 actuate intake and exhaust valves 24,26 via intake and exhaust cam rocker arms 42 and 43. Stationary lash adjusters 44 are located intermediate of the valves 24,26 and cam rocker arms 42,43 and function to reduce valve lash. In the configuration shown, each cam rocker arm 42,43 contacts the corresponding cam 28,29 directly through a roller cam follower 46 which actuates valve stem 48 to open the valve against a closing bias of a return spring 50.

Figures 2, 3:
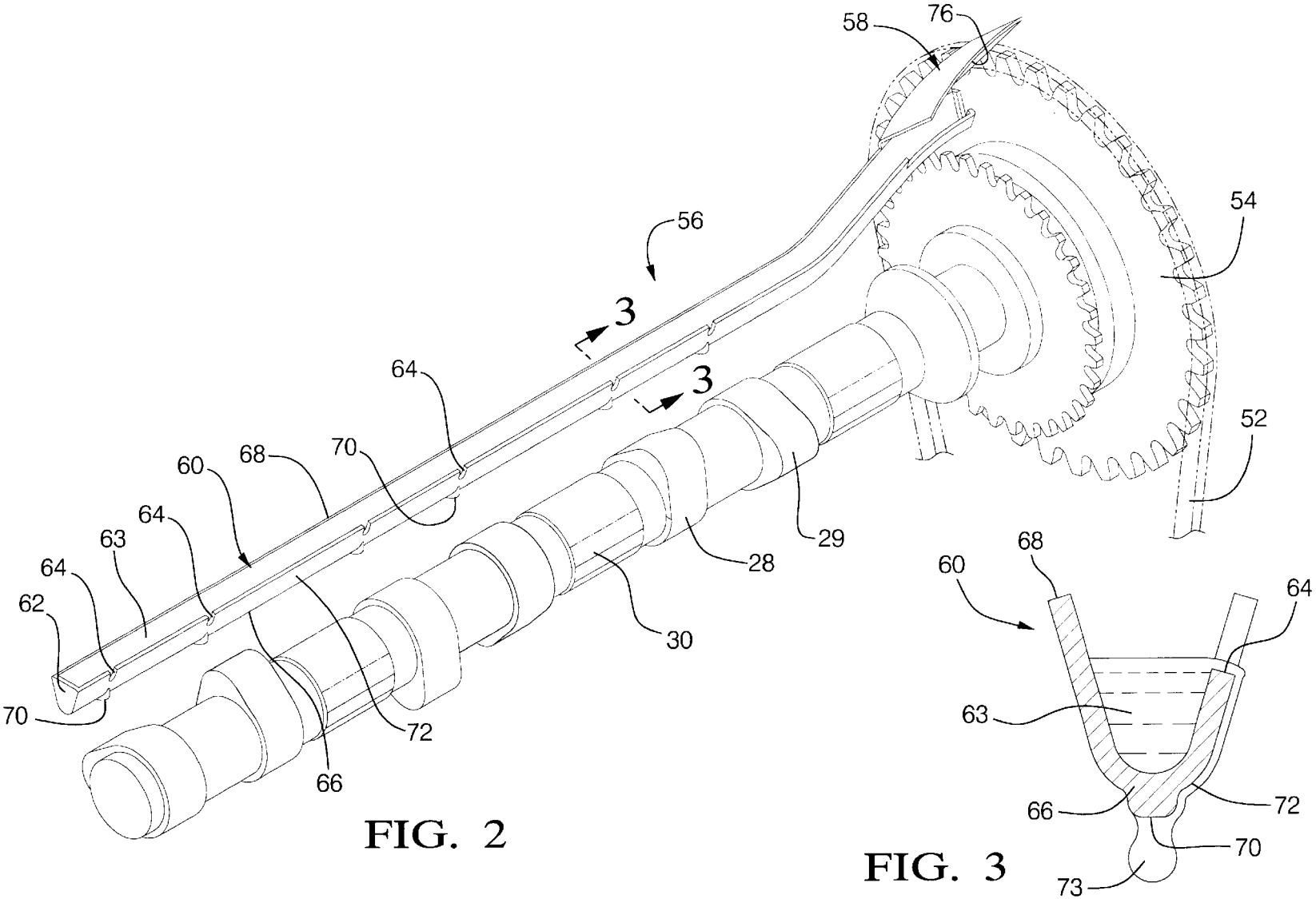
FIG. 2 is an isometric view of a portion of the OHC engine of FIG. 1.
FIG. 3 is a section 3—3 of FIG. 2.

A crankshaft, not shown, drives the camshaft 30 by an oil lubricated camshaft drive chain 52, engaging a cam sprocket 54 secured to the end of the camshaft, FIG. 2.

FIGS. 2 and 3 illustrate a valve train lubricating assembly 56, including a baffle portion 58 and a reservoir trough portion 60, which is a part of the engine lubrication system. The baffle 58 is a generally side-facing surface which inverts into trough 60. In the preferred embodiment shown in the figures, the trough 60 is an upward facing U-shaped channel. The trough 60 is closed at one end by an end wall 62 which defines a reservoir 63. The trough 60 includes side outlets 64, which may be slots or holes, located at a height intermediate of the bottom 66 and the top 68 thereof. Outward protruding dimples 70 in the outer surface 72 of the trough are located below the side outlets 64 to precipitate oil drips 73 from oil flowing out the side outlets. The valve train lubricating assembly 56 may be made of any material that is durable in an oil environment, such as steel, aluminum, or polymeric material.

The valve train lubricating assembly 56 is disposed above the cylinder head 14, within a cover volume 74 defined by the cylinder head and the cam cover 16. The baffle 58 is radially spaced from the drive chain 52 and extends partially about the drive chain 52 and cam sprocket 54. The trough 60 is positioned adjacent and above the camshaft 30, parallel to the longitudinal axis of the camshaft.

During operation, the drive chain 52 is lubricated by the engine lubrication system, primarily as it passes through the engine oil reservoir, not shown. As the chain 52 is driven around the sprocket 54, centrifugal force creates a steady spray of oil from the chain and cam sprockets. Oil spray is captured on the inner surface 76 of the baffle 58 and flows along the baffle 58 as the baffle inverts into the trough 60. The oil fills the reservoir 63 until the oil level reaches the height of the side outlets 64 allowing oil to overflow from the side outlets generally equally. The oil flows along the outer surface 72 of the trough 60, to collect on the outward protruding dimples 70. The dimples 70 act as precipitation points to target and direct the oil onto the valve train assembly 23 below, particularly to cams 28,29 or roller cam followers 46.

With the present invention, oil that has been used in a first lubrication of the drive chain 52 and cam sprocket 54, may be efficiently reused in a second location without adding to the system lubrication load or reducing system oil pressure.

Although the invention is disclosed in a single OHC engine, it is equally applicable in a dual OHC engine. A valve train lubricating assembly may be mounted above each of the camshafts, where the baffle is positioned to catch oil from a crankshaft-to-camshaft drive chain or camshaft-to-camshaft drive chain.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

We claim:

1. An overhead cam engine having a lubrication system comprising a cylinder head, a valve train assembly having a camshaft rotatably supported by said cylinder head, an oil lubricated camshaft drive chain engaged with and operable to rotate said camshaft, and a valve train lubricating assembly disposed above said cylinder head and including a baffle, radially positioned from said drive chain and extending partially about said drive chain, operable to capture oil spray departing said drive chain and to conduct the oil to a trough positioned above said valve train assembly to distribute oil onto said valve train assembly.

2. An overhead cam engine having a lubrication system, as defined in claim 1, wherein said trough is configured as an upward-facing U-shaped channel including an end wall to close said trough to thereby define a reservoir therein, for collecting oil from said baffle, and side outlets operable to allow oil to overflow from said trough for distribution onto said valve train assembly.

3. An overhead cam engine with a lubrication system, as defined in claim 2, in which said trough comprises outward protruding dimples for precipitation of oil overflowing from said side outlets to target lubrication onto said valve train assembly.

4. An overhead cam engine with a lubrication system, as defined in claim 1, wherein said baffle is a generally side-facing surface which inverts into said trough.

5. An overhead cam engine with a lubrication system, as defined in claim 1, said camshaft having a camshaft drive sprocket engaging said drive chain and operable to rotate said camshaft.

* * * * *